United States Patent [19]

Cipolla et al.

[11] Patent Number: 4,937,628

[45] Date of Patent: Jun. 26, 1990

[54] APPARATUS FOR STORING AND DISPENSING PARTICULATE MATERIAL

[75] Inventors: Stephen D. Cipolla, Penfield; Richard C. Dray, Jr., Ontario; Donald R. Fess; Karai P. Premnath, both of Rochester, all of N.Y.

[73] Assignee: Xerox Corporation, Stamford, Conn.

[21] Appl. No.: 334,646

[22] Filed: Apr. 7, 1989

[51] Int. Cl.[5] ..... G03G 15/08

[52] U.S. Cl. ..... 355/260; 222/DIG. 1; 141/364

[58] Field of Search ..... 355/245, 260; 222/DIG. 1; 141/363, 364; 118/653

[56] References Cited

U.S. PATENT DOCUMENTS

| | | | |
|---|---|---|---|
| 3,339,807 | 9/1967 | Eichorn | 222/171 |
| 3,385,500 | 5/1968 | Lavander | 229/7 |
| 3,501,065 | 3/1970 | Altmann et al. | 222/392 |
| 3,539,077 | 11/1970 | Drepler | 222/82 |
| 3,618,826 | 11/1971 | Kangas | 222/166 |
| 3,999,654 | 12/1976 | Pollack | 206/216 |
| 4,062,385 | 12/1977 | Katsusha et al. | 141/364 X |
| 4,065,335 | 12/1977 | Pollack | 156/69 |
| 4,478,512 | 10/1984 | Zoltner | 355/3 DD |
| 4,491,161 | 1/1985 | Tamura et al. | 141/364 |
| 4,650,070 | 3/1987 | Oka et al. | 206/216 |

FOREIGN PATENT DOCUMENTS

| | | | |
|---|---|---|---|
| 58-18658 | 2/1983 | Japan | 355/260 |

*Primary Examiner*—Joan H. Pendegrass

[57] ABSTRACT

Apparatus for storing and dispensing particulate material comprising a container defining a chamber for storing particulate material having an opening in the surface for dispensing particulate material which may be closed and sealed. The opening has a frame member attached to the container enclosing the opening which has two spaced parallel rails one each on a side of the opening and a movable door member larger than the opening with two parallel tracks spaced to enable them to slide in the rails to move said door between a closed position to cover the opening and an open position to open the door and between the door frame member and the door a compressible micro-cellular open celled foam seal having a low compression set, a low surface energy surface and a thickness in the uncompressed state greater than the distance between the door frame and the door when the door is in the closd position the foam being compressed on sealing the space between the door frame and the door when the door is in the closed position to prevent particulate material from escaping from the container.

20 Claims, 4 Drawing Sheets

APPARATUS FOR STORING AND DISPENSING PARTICULATE MATERIAL

BACKGROUND OF THE INVENTION

The present invention relates to apparatus for storing and dispensing particulate material and in particular to a toner or developer cartridge for electrostatographic printing machines.

In an electrostatographic reproducing apparatus commonly in use today, a photoconductive insulating member is typically charged to a uniform potential and thereafter exposed to a light image of an original document to be reproduced. The exposure discharges the photoconductive insulating surface in exposed or background areas and creates an electrostatic latent image on the member which corresponds to the image areas contained within the usual document. Subsequently, the electrostatic latent image on the photoconductive insulating surface is made visible by developing the image with developing powder referred to in the art as toner. Most development systems employ a developer material which comprises both charged carrier particles and charged toner particles which triboelectrically adhere to the carrier particles. During development the toner particles are attracted from the carrier particles by the charge pattern of the image areas in the photoconductive insulating area to form a powder image on the photoconductive area. This image may subsequently be transferred to a support surface such as copy paper to which it may be permanently affixed by heating or by the application of pressure. Following transfer of the toner image to a support surface, the photoconductive insulating member is cleaned of any residual toner that may remain thereon in preparation for the next imaging cycle.

As the toner particles are depleted from the developer material it is necessary to dispense additional toner particles into the developer mixture. Further, the carrier has a limited life due to a variety of problems occurring with continued use. For example, the carrier may become impacted with toner thereby altering its triboelectric properties or if the carrier is coated with the material to enhance triboelectric properties the coating may deteriorate with time. U.S. Pat. No. 4,614,165 to Folkins et al. describes a developing process involving the addition of both toner particles and carrier particles to the developer in the developer housing to insure that the usable life of the developer material in the chamber at any point in time is at least equal to the life of the photographic printing machine. To accommodate the addition of further carrier and toner material, waste or spent developer is removed from the developer housing when it seems to exceeds a predetermined quantity. Thus, in most commercial embodiments the concentration of toner particles within the developer mixture is maintained substantially constant. To achieve this particulate material containers for toner and/or developer which discharge the toner and/or developer into the development system have been used. In replenishing the toner particles in an electrostatographic printing machine, it is important to minimize any spillage which may result in contamination of otherwise uncontaminated areas. Further, the toner particles being very finely ground may become airborne carrying this contamination to other areas but immediately adjacent the development system. In addition, the spilled toner particles have a tendency to cling to an operator's hands or to the surrounding environment. Accordingly, there is a need to provide a toner and/or developer storing and dispensing device which may be used to periodically replenish the toner and/or developer in an automatic printing machine and which can avoid the above difficulties thereby overcoming a dirty and messy operation.

While the desire to minimize contamination by the toner or developer and provide for "white glove" machine operator involvement during the replenishment activity of the toner or developer is of paramount importance it is also noted that the toner and/or the developer container must be capable of containing the toner and/or developer during periods of storage and/or shipment under conditions which may go from one extreme to another by way of temperature, pressure and/or impact. A common approach to sealing a toner container or cartridge has been to seal the dispensing opening with a breathable plastic film of polyvinyl chloride, for example, which has a pressure and heat actuated adhesive on one side which upon the application of heat and pressure forms a very good seal with the dispensing opening. When necessary for use, the dispensing opening can be opened and particulate materials emptied into the developer housing. A principle difficulty, however, associated with this type of sealing arrangement is the preciseness required for pressure, temperature and time in sealing the toner cartridge. For example, if a hot iron is left on to long, it may burn or melt through the plastic film. Accordingly, it has been found that the plastic film is generally too time temperature dependent. In addition, the adhesive is frequently applied unevenly and with the uneven application of the adhesive in trying to manually peel or remove the film from the opening the force that may have to applied may be uneven and an ineffective seal may be formed in areas where too little adhesive is applied. Further, once this plastic film seal is broken and upon exhaustion of the supply of toner and/or developer in the cartridge so that it must be removed and replenished with a full cartridge, there is really effectively no seal to protect the user from toner spillage and contamination upon loading the cartridge from the machine.

PRIOR ART

U.S. Pat. No. 4,478,512 to Zoltner discloses a toner cartridge for an electrophotographic printing machine including an opening in the surface of the cartridge, a flexible sealing strip secured removably on that opening, and means for automatic opening of the cartridge upon inserting in a dispensing unit of the printing machine.

U.S. Pat. No. 4,650,070 to Oka et al. discloses a toner cartridge for an electrophotographic copier including a container having an opening, a cover slidably movable with respect to the container between a closed position and an open position on that opening, and a sealed member having one end fixed to the container and another end fixed to the cover.

SUMMARY OF THE INVENTION

In accordance with the principle aspect of the present invention apparatus for storing and dispensing particulate material comprises a container having an opening in the surface for dispensing particulate material which has a closure and sealing device including a frame member enclosing the opening with two-spaced parallel rails and each on a side of the opening, a movable door member larger than the opening with two parallel tracks conformable with the rails and spaced to enable them to slide in the rails to move the door between a closed position to cover the opening and an open position to open the opening and a compressible micro-cellular open celled foam seal between the door frame and the door which has a low compression set a smooth low surface energy surface and a thickness in the uncompressed state greater than the distance between the door frame and the door when the door is in the closed position to form a compression seal to prevent particulate material from escaping from the container.

In a further aspect of the present invention the container is an elongated arcuate tube-like cartridge and the door frame rails and door and door tracks are arcuate conforming to the arcuate container surface.

In a further aspect of the present invention the container is a molded plastic cartridge and the door frame is integrally molded therewith.

In a further aspect of the present invention the foam is secured to the door frame around the opening and the door frame includes elevated compression ridges around the opening and under the foam, the height of such ridges being selected to compress the foam from about 20% to 30% in the space between the door frame and the door when the door is in the closed position covering the opening.

In a further aspect of the present invention the door frame has a door stop member at one end of each rail to stop the door tracks when the door is in the closed position covering the opening.

In a further aspect of the present invention, the door has two-finger like projections engageable with slots in a host housing for association therewith in moving the door frame from the open position to the closed position and wherein the force supplied to the finger like projections in the direction of travel of the door to open and close the door is between 1.5 kilograms and about 5 kilograms.

In a further aspect of the present invention the foam is a microcellular polyurethane with open cells less than 4 micrometers in maximun dimension and having a compression set recovery greater than 98% within twenty four hours after 50% compression for twenty-four hours at 23° C.

In a further aspect of the present invention, the edge of the door adjacent the door stop members when the door is in the closed position is beveled to present a non-destructive edge to the foam when the door is moved from the open position over a portion of the foam to the closed position.

In accordance with a further aspect of the present invention an electrostatographic printing machine which produces fixed toner images on a receiving sheet is provided with a novel removable developer cartridge as provided herein.

In accordance with a further aspect of the present invention, the rails have a beveled top surface to enable the door to be assembled to the door frame by engaging a first track with its corresponding rail and snapping the remaining track into its corresponding rail.

In accordance with a further aspect of the present invention, the matting surfaces of the parallel rails and tracks are beveled such that when a pressure is exerted on the door from the interior of the container the tracks tend to hook into the rails thereby forming an additional seal.

Other features of the present invention will become apparent as the following description proceeds and upon reference to the drawings.

DESCRIPTION OF THE PREFERRED EMBODIMENT

The invention will now be described with reference to a preferred embodiment of the developer dispensing cartridge in an electrostatographic printing machine.

Figure 1:
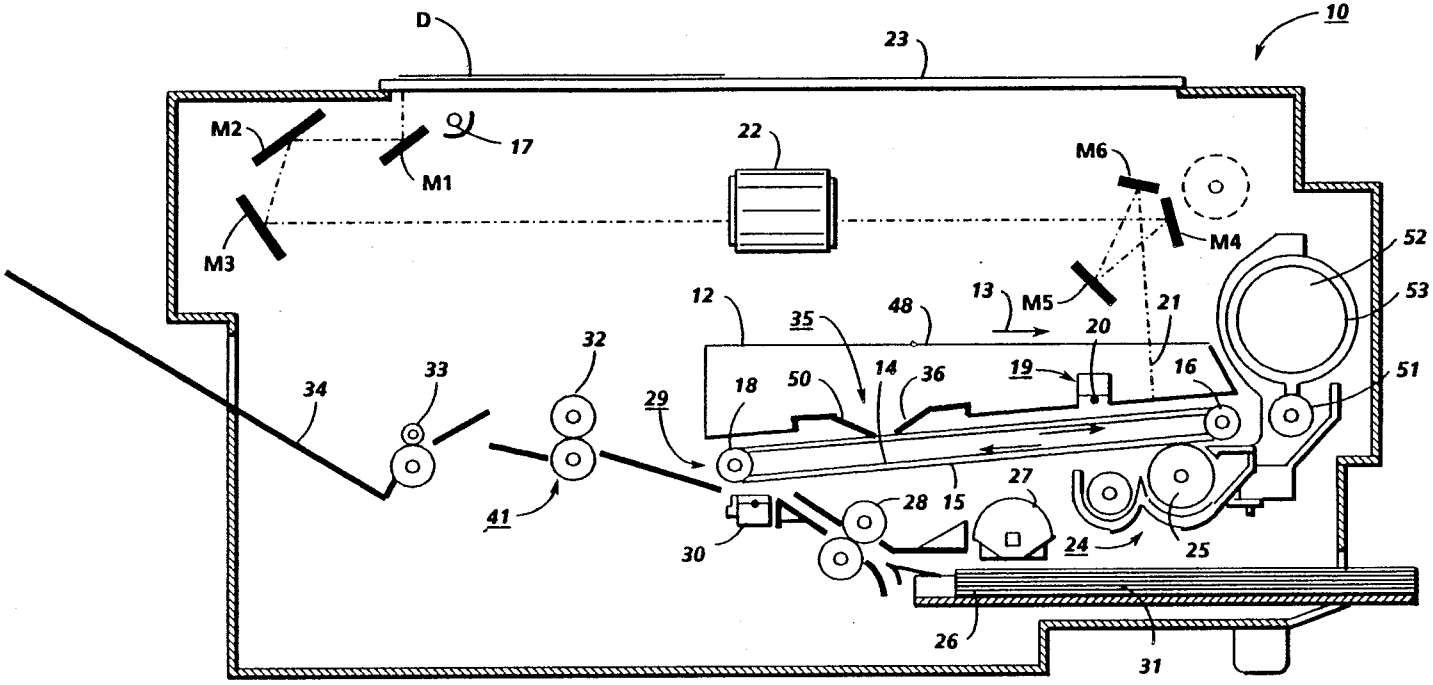
FIG. 1 is a schematic representation in cross section of an automatic electrostatographic printing machine with the removable developer cartridge according to the present invention.

Referring now to FIG. 1, there is shown by way of example, an automatic electrostatographic reproducing machine 10 which includes a developer dispensing cartridge according to the present invention. The reproducing machine depicted in FIG. 1 illustrates the various components utilized therein for producing copies from an original document. Although the apparatus of the present invention is particularly well adapted for use in automatic electrostatographic reproducing machines, it should become evident from the following description that it is equally well suited for use in a wide variety of processing systems including other electrostatographic systems and is not necessarily limited in application to the particular embodiment or embodiment shown herein.

The reproducing machine 10 illustrated in FIG. 1 employs a removable processing cartridge 12 which may be inserted and withdrawn from the main machine frame in the direction of arrow 13. Cartridge 12 includes an image recoding belt like member 14 the outer periphery of which is coated with a suitable photoconductive material 15. The belt is suitably mounted for revolution within the cartridge about driven transport roll 16, around idler roll 18 and travels in the direction indicated by the arrows on the inner run of the belt to bring the image bearing surface thereon past the plurality of xerographic processing stations. Suitable drive means such as a motor, not shown, are provided to power and coordinate the motion of the various cooperating machine components whereby a faithful reproduction of the original input scene information is recorded upon a sheet of final support material 31, such as paper or the like.

Initially, the belt 14 moves the photoconductive surface 15 through a charging station 19 wherein the belt is uniformly charged with an electrostatic charge placed on the photoconductive surface by charge corotron 20 is known manner preparatory to imaging. Thereafter, the belt 14 is driven to exposure station 21 wherein the charged photoconductive surface 15 is exposed to the light image of the original input scene information, whereby the charge is selectively dissipated in the light exposed regions to record the original input scene in the form of electrostatic latent image.

The optical arrangement creating the latent image comprises a scanning optical system with lamp 17 and mirrors $M_1$, $M_2$, $M_3$ mounted to a a scanning carriage (not shown) to scan the original document D on the imaging platen 23, lens 22 and mirrors $M_4$, $M_5$, $M_6$ to transmit the image to the photoconductive belt in known manner. The speed of the scanning carriage and the speed of the photoconductive belt are synchronized to provide faithful reproduction of the original document. After exposure of belt 14 the electrostatic latent image recorded on the photoconductive surface 15 is transported to development station 24, wherein developer is applied to the photoconductive surface 15 of the belt 14 rendering the latent image visible. The development station includes a magnetic brush development system including developer roll 25 utilizing a magnetizable developer mix having coarse magnetic carrier granules and toner colorant particles, the developer roll is supplied with toner and/or carrier from a dispensing cartridge 53 which is removably insertable into the developer dispensing housing 52 and which is transported to the developer roll by auger system 51.

Sheets 31 of the final support material are supported in a stack arranged on elevated stack support tray 26. With the stack at its elevated position, the sheet separator segmented feed roll 27 feeds individual sheets therefrom to the registration pinch roll pair 28. The sheet is then forwarded to the transfer station 29 in proper registration with the image on the belt and the developed image on the photoconductive surface 15 is brought into contact with the sheet 31 of final support material within the transfer station 29 and the toner image is transferred from the photoconductive surface 15 to the contacting side of the final support sheet 31 by means of transfer corotron 30. Following transfer of the image, the final support material which may be paper, plastic, etc., as desired, is separated from the belt by the beam strength of the support material 31 as it passes around the idler roll 18, and the sheet containing the toner image thereon is advanced to fixing station 41 wherein roll fuser 32 fixes the transferred powder image thereto. After fusing the toner image to the copy sheet the sheet 31 is advanced by output rolls 33 to sheet stacking tray 34.

Although a preponderance of toner powder is transferred to the final support material 31, invariably some residual toner remains on the photoconductive surface 15 after the transfer of the toner powder image to the final support material. The residual toner particles remaining on the photoconductive surface after the transfer operation are removed from the belt 14 by the cleaning station 35 which comprises a cleaning blade 36 in scrapping contact with the outer periphery of the belt 14 and contained within cleaning housing 48 which has a cleaning seal 50 associated with the upstream opening of the cleaning housing. Alternatively, the toner particles may be mechanically cleaned from the photoconductive surface by a cleaning brush as is well known in the art.

It is believed that the foregoing general description is sufficient for the purposes of the present application to illustrate the general operation of an automatic xerographic copier 10 which can embody the apparatus in accordance with the present invention.

Figure 2:
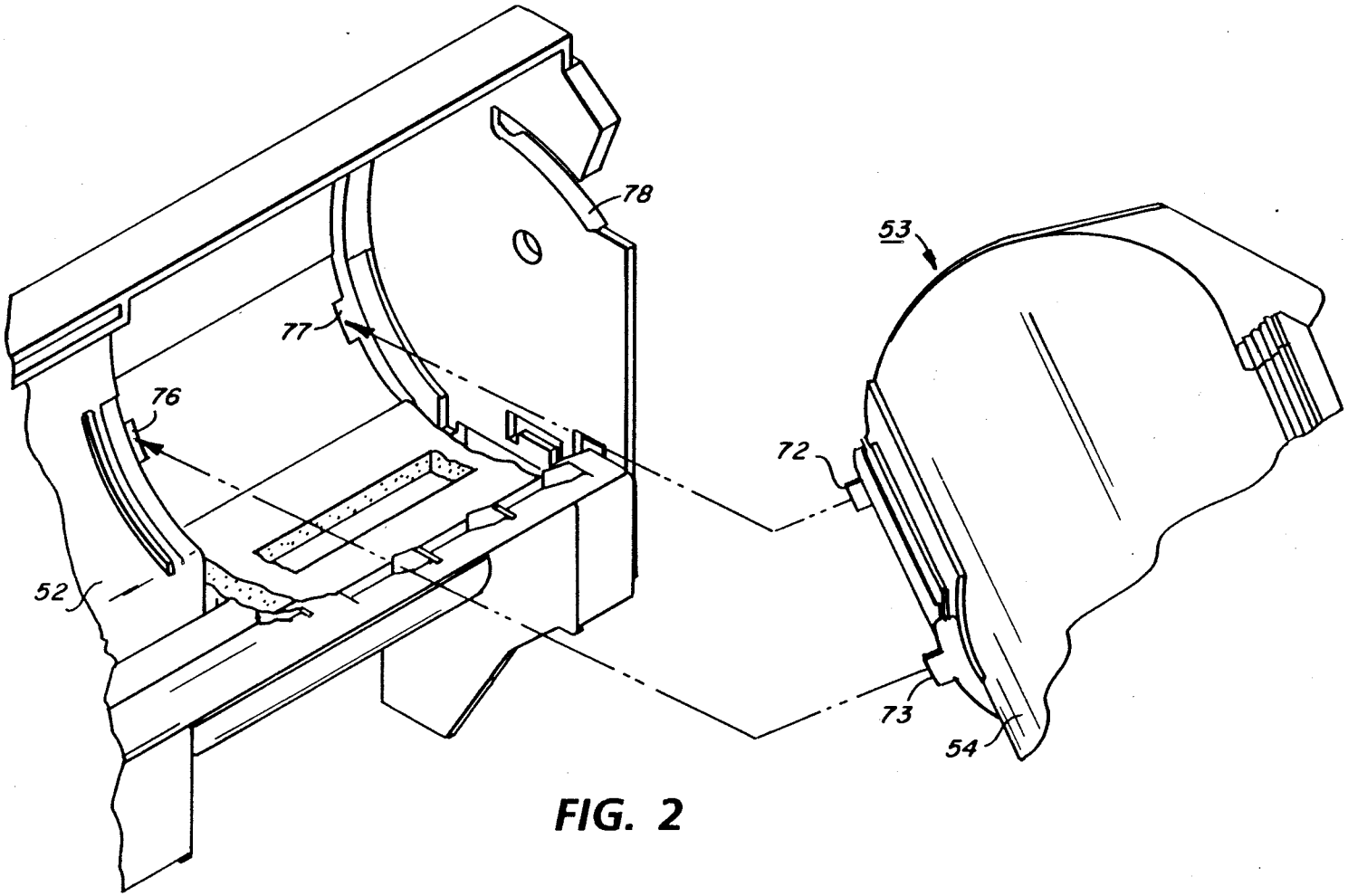
FIG. 2 is an isometric view of a developer housing illustrating the means for mounting the removable developer cartridge therefrom.
Figure 3:
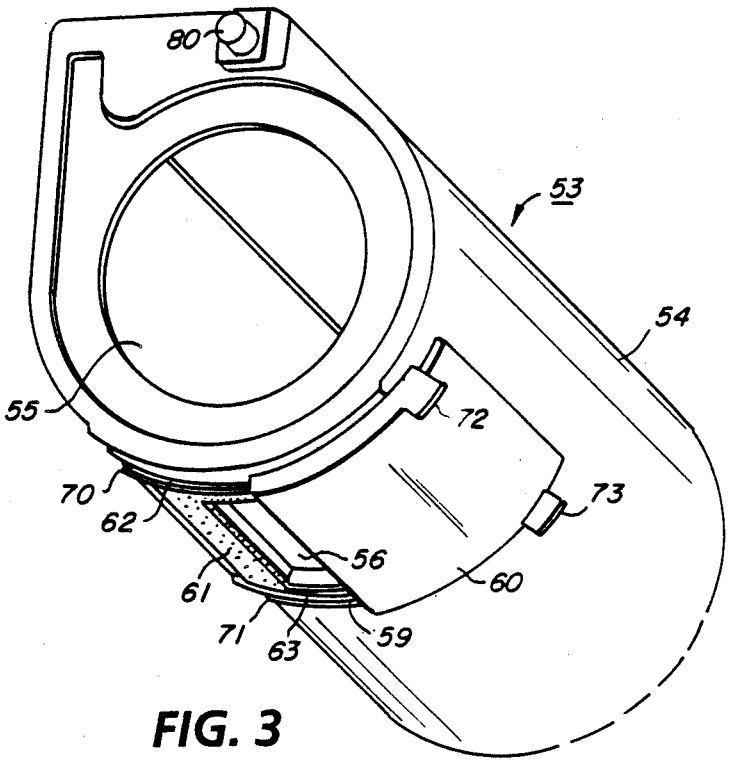
FIG. 3 is an enlarged isometic view of one end of the developer cartridge showing the closure and sealing arrangement of the storing and dispensing cartridge according to the present invention.
Figure 4:
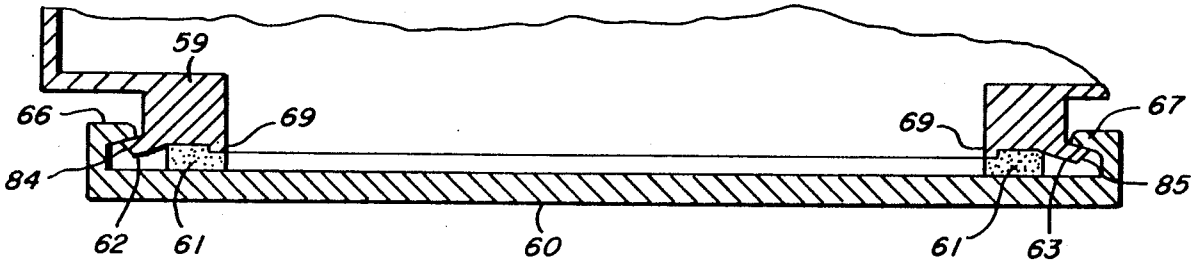
FIG. 4 is a view in cross-section illustrating the location and geometry of the door frame rails, ridges, foam seal and the door tracks.

Attention is directed to FIGS. 3 and 4 with additional reference to FIG. 2 for the details of the particulate material storing and dispensing cartridge having a closure and sealing assembly. In FIG. 3, the cartridge 53 is illustrated as an elongated arcuate tube-like container 54 defining a storage chamber 55 for particulate material having an opening in the surface for dispensing the particulate material therefrom. The dispensing opening 56 is provided with a closure and sealing device which includes an interactive door frame member 59, a movable door 60 and a foam seal 61. The geometry is such that the door frame member is attached to the surface of the container and encloses the dispensing opening. The door frame member has two parallel rails 62, and 63 one on a side of the dispensing opening which are engageable with two parallel tracks 66 and 67 on the movable door member, the tracks and the rails being conformable with each other and spaced to enable the door to slide in the rails to move the door between a closed position to cover the dispensing opening and an open position to dispense developer. Positioned between the door frame member 59 and the door 60 is a foam seal 61 which has a thickness in the uncompressed state greater than the distance between the door frame and the door when the door is in the closed position and which when compressed seals the space between the door frame and the door when the door is in the closed position to prevent the particulate material from escaping from the container. As illustrated the door frame and the door as well the foam and the rails and the door and the tracks in the door are arcuate conforming to the arcuate configuration of the cartridge surface. The door frame should be securely attached to the portion of the container around the dispensing opening. This may be accomplished by any suitable means with the use of adhesives, welding, ultrasonic welding and the like. The particularly preferred approach is to provide the door frame integrally molded with the cartridge when the cartridge is made from a moldable plastic.

To enhance the sealing effect between the door frame and the door, the door frame is preferably provided with a compression ridge or ridges 69 which also may be integrally molded in the door frame around the dispensing opening. These raised ridges form an additional compression or pinch in the foam seal. The door frame also has door stop members 70 and 71 at the end of each of the rails 62 and 63 to stop the door tracks 66 and 67 when the door is in the fully closed position covering the dispensing opening. The door 60 is movable between an open position wherein the dispensing opening is open and a closed position wherein the dispensing opening is closed and to accomplish this the tracks 66 and 67 on the door are shaped to conform to and ride or slide in the rails 62 and 63 on the door frame. The door is also provided with two finger-like projections 72 and 73 which are engageable with mounting slots 76 and 77 (see FIG. 2) in the developer dispensing housing for association therewith in moving the door from the open position to the closed position. This is accomplished by inserting the developer dispensing cartridge 53 in the cavity in the developer dispensing housing with the mounting channels 78, one on each end of the developer dispensing housing engaging the mounting pins 80, one on each end of the cartridge. Once inserted in an initial position, the cartridge is rotated counterclockwise so that the mounting pins 80 move in the mounting channels 78. At the same time, the finger-like projections 72 and 73 on the cartridge are inserted into the mounting slots 76 and 77 in the developer housing when the cartridge is inserted in the initial position so that upon subsequent rotation the cartridge door remains stationary while the cartridge is rotated thereby unsealing the door in the door frame and opening the dispensing opening. When any particular cartridge is depleted of developer the procedure may be reversed so that the door is moved to the closed position covering the dispensing opening and resealing the door in the door frame as the container of the cartridge is rotated in the clockwise direction. While it is illustrated as providing an operation wherein the container moves and the door is stationery, it will be understood that the reverse can take place wherein the door moves and the container is stationary it being required only that the door does move relative to the container.

With further reference to FIGS. 3 and 4, the height of the ridges is selected so that the foam is compressed about 20% to about 30% to form the seal. It should be noted that too high a compression may result in too high a door opening force and too low a compression too low a force for door opening and possibly the formation of a very poor seal. Accordingly, a compression of about 20% to 30% has been found to be an optimum balance between door opening force and sealing effectiveness. The door and door frame are typically made from conventional thermoplastic and thermosetting polymers such as polyvinyl chloride, polyethylene, polypropylene and polyesters, phenolics, epoxies which may be reinforced and non-reinforced with fillers. Polystyrene is a particularly satisfactory material for use in providing a door and door frame geometry in a thickness that can resist deformation by forces of loading developer or dropping the filled cartridge and resist developer from leaking out.

Figure 5:
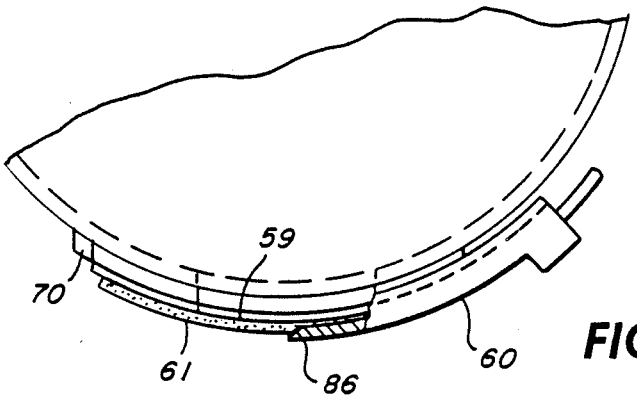
FIG. 5 is a view in cross section through the door showing the bevel and foam.
Figure 6:
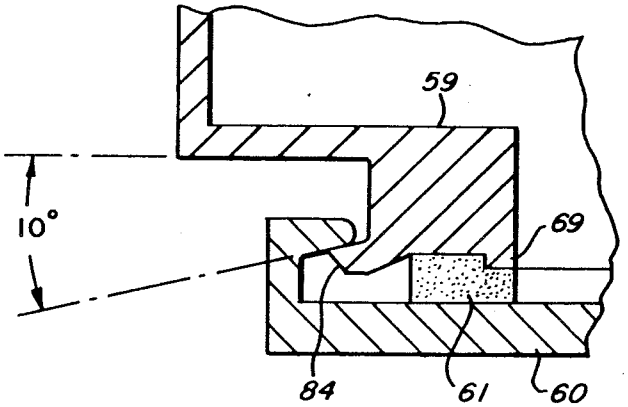
FIG. 6 is an enlargement of one end of FIG. 4 showing the mating surfaces of the track and rods.

As illustrated in FIG. 6, the ends of the rails have a beveled top surface 84 and 85 to enable the rail door to be assembled to the door frame by engaging a first track of the door with its corresponding rail and snapping the remaining track into its corresponding rail. In addition, as illustrated in FIG. 5, the edge of the door adjacent the door stop member when the door is in the closed position is beveled to present a non-destructive edge 86 to the foam when the door is moved from the open position over a portion of the foam to the closed position. Otherwise, there would be a tendency for the lead edge of the door when moving back to the closed position to plow into the foam seal potentially creating a leak in the seal. The bevel 86 may be of any suitable angle depending on the overall geometry of the device which is effective in easing the door into position. An angle of about 45° has been found particularly effective.

In addition, as illustrated in FIG. 6, the mating surface of the parallel rails on the door frame and the parallel tracks on the door itself are beveled such that when a pressure is exerted on the door from the chamber of the container the tracks tend to hook into the rails thereby forming an additional seal. Typically, a shallow angle of the order of about 10° has been effective in forming this additional sealing arrangement.

The foam seal is made from any suitable material. Preferably it is a compressible micro-cellular open celled foam having a low compression set and a smooth low surface energy surface. By the term low compression set it is intended to define a quick recovery to the original shape after deformation. In this regard, the foam will preferably have a compression set recovery greater than 98% within twenty hours often after 50% compression for twenty four hours at 23° C. Preferably, the foam is an opened cell foam which in addition to enabling generally faster recovery from deformation than closed cell foams, enables the equilization of air pressure within the cartridge to ambient air pressure which otherwise might result in an undesired force tending to drive toner out of the cartridge. In addition the foam is preferably micro-cellular which effectively retards the migration of a fine size toner particles through the bulk of the foam. Since the size of the toner particles is of the order of 4 micrometers the cells of the micro-cellular open celled foam are preferably less than 4 micrometers in maximum dimension. In addition, the foam also preferably has a smooth low surface energy surface to further enable a relatively low door opening force and a non-stick surface. The surface energy level of the foam surface as indicated by the coefficient of kinetic friction is generally less than 0.35 and preferably in the range of from about 0.2 to about 0.3. Naturally, the foam should be compatible with the materials of which the toner and the cartridge are made and should not become brittle or otherwise degrade over time. As previously discussed, the door opening force, that force applied to the finger-like tab members in the direction of travel of the door to open and close the door, should not be too high nor too low. Typically, door opening forces within the range of from about 1.5 kilograms to 5 kilograms have worked well and the smoothness surface energy and the thickness of the foam can be selected to provide such a door opening force. Typical materials include the micro-cellular polyurethanes and polystyrenes commercially available. Typically preferred material is Poron 4701-01-20 available from Rogers Corporation of East Woodstock, Conn. which has a compression set recovery greater than 98% within twenty four hours after 50% compression for twenty four hours at 23° C. and a density of 320 kilograms per cubic meter. This material may be formed through an extrusion process wherein the thickness of the foam can be relatively closely controlled thereby enabling a more uniformed sealing action. The foam may be attached to the door frame in the shape of a square or rectangle surrounding the opening and is associated with the raised ridges previously discussed and secured thereto to in any suitable manner. Preferably, a pressure sensitive adhesive with high peel adhesion which is compatible with the toner and the door materials is used rather than a heat sensitive material which during application and heating could cause damage and warping on the door frame assembly. Typical material include the commercially available pressure sensitive modified acrylic adhesives such as cyanoacrylic adhesive.

Thus, according to the present invention, an apparatus for storing and dispensing particulate material has been provided which can be sealed after loading unsealed to dispense material and re-sealed after it has been exhausted has been provided. A cost effective reliable seal with a re-seal feature enabling a white glove operation for a machine operator is provided. By inserting the cartridge in an initial position and rotating the mounting pins through the mounting channels the seal is broken and the dispensing opening opened. Upon exhaustion of the toner in the cartridge rotating the cartridge in the reverse direction automatically re-seals the exhausted cartridge.

The disclosure of the patents referred to herein is hereby specifically and totally incorporated herein by reference.

While the invention has been described with reference to specific embodiments, it will be apparent to those skilled in the art that many alternatives, modifications and variations may be made. For example, while the invention has been illustrated with reference to an elongated arcuate tube-like cartridge having a conforming arcuate door frame and door it will be understood that the cartridge and/or the door frame and door closure and sealing means may be planar rather than arcuate. In addition, while the sealing foam that has been illustrated as being secured to the door frame, it will be understood that it may be secured to the inside surface of the door as a solid piece rather than a gasket.

Furthermore, it will be understood that while the invention has been described with reference to the dispensing of the toner or a developer material in an electrostatographic printing machine, it will be appreciated that it can be used for the storing and dispensing of a variety of particulate materials. Accordingly, it is intended to embrace all such alternatives, modifications as may fall within the spirit and scope of the appended claims.

We claim:

1. An apparatus for storing and dispensing particulate material comprising a container defining a chamber for storing particulate material having an opening in the surface thereof for dispensing particulate material therefrom, said opening having closure and sealing means comprising a frame member attached to said container enclosing said opening, said frame member including two spaced parallel rails one each on a side of said opening, a movable door member larger than said opening with two parallel tracks spaced to enable them to slide in said rails to move said door between a closed position to cover said opening and an open position to open said opening and between said door frame member and said door a compressible micro-cellular open celled foam seal, said foam having a low compression set, a low surface energy surface and a thickness in the uncompressed state greater than the distance between the door frame and the door when the door is in the closed position, said foam being compressed on sealing the space between the door frame and the door when the door is in the closed position to prevent particulate material from escaping from the container.

2. The apparatus of claim 1 wherein said container is an elongated arcuate tube-like cartridge, and said door frame, door frame rails, said door and door tracks are arcuate conforming to the arcuate container surface.

3. The apparatus of claim 1 wherein said container comprises a molded plastic cartridge and said door frame is integrally molded therewith.

4. The apparatus of claim 1 wherein said foam is secured to said door frame around said opening, said door frame including elevated compression ridges around said opening and under said foam the height of said ridges being selected to compress said foam from about 20% to 30% in the space between the door frame and the door when said door is in the closed position covering said opening.

5. The apparatus of claim 1 wherein said door frame has a door stop member at one end of each rail to stop the door tracks when said door is in the closed position covering said opening.

6. The apparatus of claim 1 wherein said door has two finger-like projections engageable with slots in a host housing for association therewith in reciprocally moving said door from said closed position to said open position and wherein the force applied to said finger-like projections in the direction of travel of the door to open and close the door is between about 1.5 kilogram and about 5 kilograms.

7. The apparatus of claim 1 wherein said foam is a micro-cellular polyurethane with open cells less than 4 micrometers in maximum dimension and having a compression set recovery greater than 98% within 24 hours after 50% compression for 24 hours at 23° C.

8. The apparatus of claim 5 wherein the edge of the door adjacent the door stop members when the door is in the closed position is beveled to present a nondestructive edge to the foam when the door is moved from the open position over a portion of the foam to the closed position.

9. The apparatus of claim 1 wherein said rails have a beveled top surface to enable said door to be assembled to said door frame by engaging a first track with its corresponding rail and snapping the remaining track into its corresponding rail.

10. The apparatus of claim 1 wherein the mating surfaces of said parallel rails and tracks are beveled such that when a pressure is exerted on the door from the chamber of the container the tracks tend to hook into the rails thereby forming an additional seal.

11. An electrostatographic printing machine comprising a main assembly including means to form an electrostatographic latent image on an insulating surface, means to develop said image with toner particles, means to transfer said image to a receiving sheet, means to fix said toner image to said receiving sheet; a removable developer cartridge operatively associated with said means to develop, said cartridge comprising a container defining a chamber for storing particulate material having an opening in the surface thereof for dispensing particulate material therefrom, said opening having closure and sealing means comprising a frame member attached to said container enclosing said opening, said frame member including two spaced parallel rails each one on a side of said opening, a movable door member larger than said opening with two parallel tracks spaced to enable them to slide in said rails to move said door between a closed position to cover said opening and an open position to open said opening and between said door frame member and said door a compressible micro-cellular open celled foam seal, said foam having a low compression set, a low surface energy surface and a thickness in the uncompressed state greater than the distance between the door frame and the door when the door is in the closed position, said foam being compressed on sealing the space between the door frame and the door when the door is in the closed position to prevent particulate material from escaping from the container.

12. The machine of claim 11 wherein said cartridge is an elongated arcuate tube-like member, and said door frame, door frame rails, said door and door tracks are arcuate conforming to the arcuate cartridge surface.

13. The machine of claim 11 wherein said cartridge is a molded plastic member and said door frame is integrally molded therewith.

14. The machine of claim 11 wherein said foam is secured to said door frame around said opening, said door frame including elevated compression ridges around said opening and under said foam the height of said ridges being selected to compress said foam from about 20% to 30% in the space between the door frame and the door when said door is in the closed position covering said opening.

15. The machine of claim 11 wherein said door frame has a door stop member at one end of each rail to stop the door tracks when said door is in the closed position covering said opening.

16. The machine of claim 11 wherein said door has two finger-like projections and said main assembly has two spaced slots, said projections being engageable with said slots for association therewith in moving said door from said closed position to said open position and wherein the force applied to said finger-like projections in the direction of travel of the door to open and close the door is between about 1.5 kilogram and about 5 kilograms.

17. The machine of claim 11 wherein said foam is a micro-cellular polyurethane with open cells less than 4 micrometers in maximum dimension and having a compression set recovery greater than 98% within 24 hours after 50% compression for 24 hours at 23° C.

18. The machine of claim 15 wherein the edge of the door adjacent the door stop members when the door is in the closed position is beveled to present a nondestructive edge to the foam when the door is moved from the open position over a portion of the foam to the closed position.

19. The machine of claim 11 wherein said rails have a beveled top surface to enable said door to be assembled to said door frame by engaging a first track with its corresponding rail and snapping the remaining track into its corresponding rail.

20. The machine of claim 11 wherein the mating surfaces of said parallel rails and tracks are beveled such that when a pressure is exerted on the door from the chamber of the container the tracks tend to hook into the rails thereby forming an additional seal.

* * * * *